United States Patent [19]

Nicholas

[11] Patent Number: 4,522,413

[45] Date of Patent: Jun. 11, 1985

[54] PAVEMENT JOINT SEAL WITH CHEVRON-SHAPED WALLS

[75] Inventor: John D. Nicholas, Holbrook, N.Y.

[73] Assignee: Elastomer Seals, Inc., Copiague, N.Y.

[21] Appl. No.: 626,193

[22] Filed: Jun. 29, 1984

[51] Int. Cl.[3] ..... F16J 15/10; E01C 11/10

[52] U.S. Cl. ..... 277/205; 277/207 R; 404/64

[58] Field of Search ..... 277/205, 207 R, 237; 404/64–66

[56] References Cited

U.S. PATENT DOCUMENTS

| | | | |
|---|---|---|---|
| 2,610,846 | 9/1952 | Hanna | 267/1.5 |
| 3,709,115 | 1/1973 | Brown | 404/65 |
| 4,457,522 | 7/1984 | Trieste et al. | 277/205 |

*Primary Examiner*—Robert S. Ward

*Attorney, Agent, or Firm*—Bauer & Amer

[57] ABSTRACT

In the current practice of using an extruded elastomeric strip as a seal in a concrete expansion joint, in which the transverse walls more particularly are embodied with a chevron shape, the improvement thereto consisting of making the angled walls of the chevron steeper and spaced more centrally thereof, so that the seal both maintains continuous contact with the vertical faces of the expansion joint and also has a predictably consistent response to compressive forces.

1 Claim, 7 Drawing Figures

PAVEMENT JOINT SEAL WITH CHEVRON-SHAPED WALLS

Figure 1:
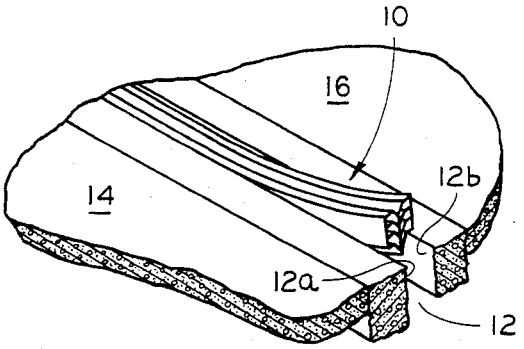

The present invention relates generally to improvements for a chevron-shaped extruded seal for a concrete expansion joint, and, more particularly, to modifications in the chevron, both as to angle and relative position, which enables the seal to maintain contact with the walls of the expansion joint and to respond with consistency to compressive forces.

Prior to the chevron-shaped sealing strip hereof, there has been prior art use made of this same shape, such as in U.S. Pat. No. 3,521,528, which obviated a significant shortcoming which consisted of a tendency of the chevron shape to pull away at the corners from the vertical faces of the expansion joint and thus produce gaps which, during use, would be filled with debris and other such uncompressible matter and thus adversely effect the manner in which the seal would contract and otherwise respond to changes in sizes of the expansion joint. The solution which obviates gapping at the corners, however, is not entirely satisfactory, since the chevron-shaped walls, when compressed, do not in practice always assume the same shape. Sometimes, the assumed shape resists further compression with less force than if another shape is assumed, with the result that the performance of the seal is not predictable nor consistent.

Broadly, it is an object of the present invention to provide a chevron-type expansion joint seal overcoming the foregoing and other shortcomings of the prior art. More particularly, it is an object to configurate the seal, so that the chevron-shaped walls move uniformly in response to external forces, and thus always assume a predictable shape when compressed which correspondingly produces consistent and predictable counterforces.

To the prior art extruded sealing strip of the type having a periphery comprised of chevron-shaped top and bottom walls and two parallel side walls joining said top and bottom walls, and having a vertically-extending interior wall connecting said chevron shapes located centrally of said top and bottom walls, the improvements to said type seal which demonstrate objects and advantages of the present invention include providing horizontally-extending length protions in the top and bottom walls which connect the side walls to the chevron shapes. As a result, the chevron shapes which are located inwardly of the wall horizontal length portions are more readily urged through descending movement in response to diminishment in size of the expansion joint instead of being squeezed between said side walls, and thus the walls of the seal do not assume distorted shapes which adversely effect the forces exerted by the seal in response to external forces.

Figure 4:
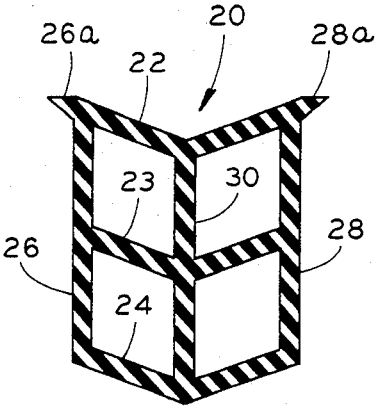
Fig. 4 PRIOR ART
Figure 5:
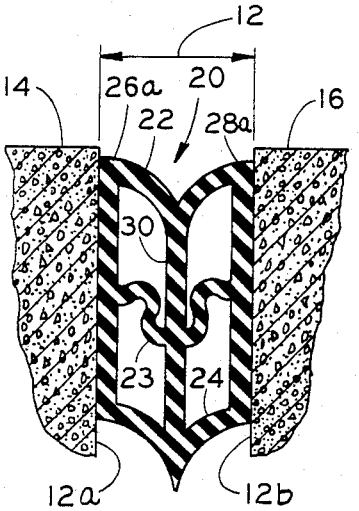
Fig. 5 PRIOR ART
Figure 6:
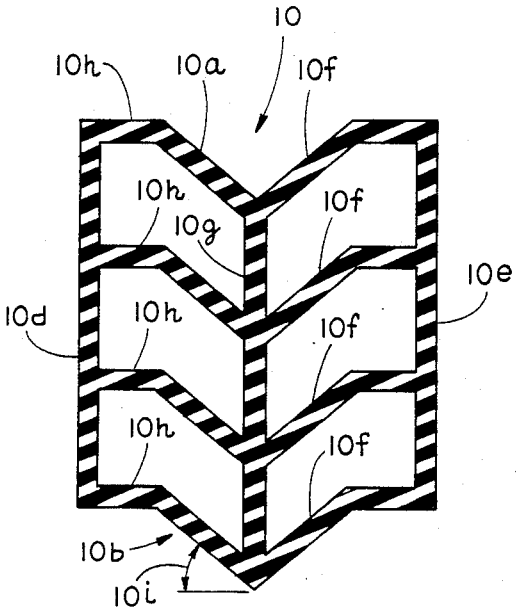
Figure 7:
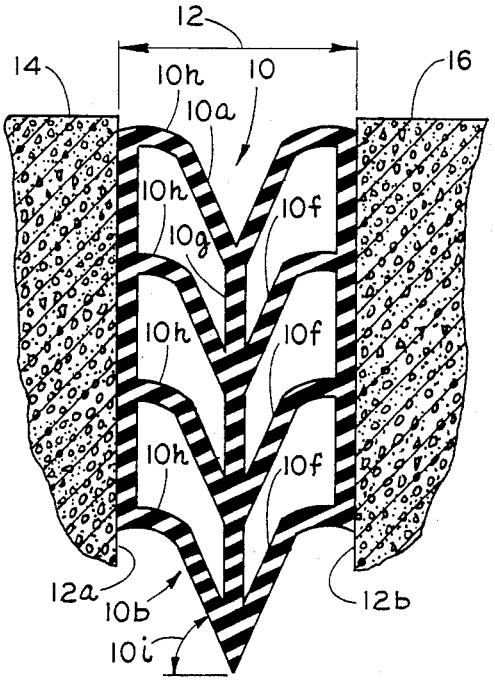

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a perspective view illustrating the sealing device hereof in its operative sealing position; and FIGS. 2–5, inclusive, are elevational views in section, illustrating prior art sealing devices and the shortcomings thereof which are obviated by the within sealing device; and FIG. 6 is similarly an elevational view in section, but illustrating details of the structural features of the within sealing device according to the present invention; and FIG. 7 illustrates the manner in which the inventive sealing device hereof responds to compression as a result of diminishment in size of the joint in the concrete structure in which it is used as a sealing member.

As already well known, use of concrete slabs in construction result in joints or spaces between adjacent slabs which require the use of sealing members which must be flexible or compressible. That is, the width of the joint will vary in response to the expansion and contraction of the concrete with temperature change. Thus, as illustrated in FIG. 1, use is made of an extrusion of an elastomeric material which produces an elongated strip, generally designated 10, which has the requisite flexibility or compressibility, and which, in practice, is used as a sealing member in a joint 12 which is bounded by opposing vertical faces 12*a* and 12*b* of adjacent concrete slabs 14 and 16, which typically may be part of a concrete construction of a highway, airport runway, building floor, ramp, or sidewalk.

Figure 2:
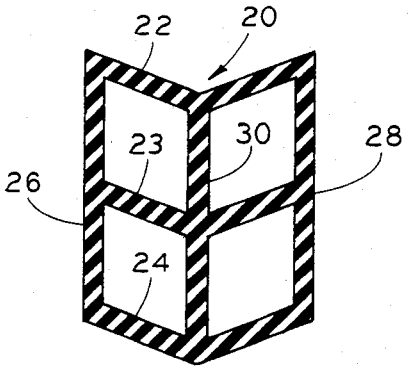
Fig. 2 PRIOR ART
Figure 3:
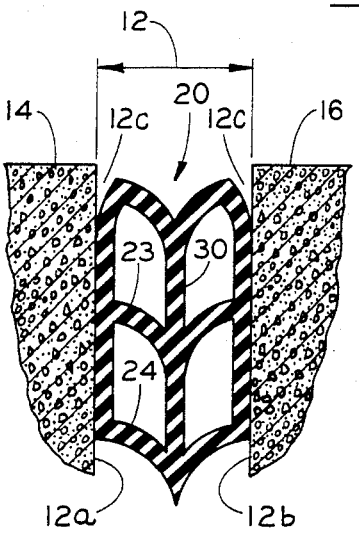
Fig. 3 PRIOR ART

Prior to the sealing strip 10 hereof, there has been prior art use made of sealing strips of other configurations and structural features. One such sealing strip is illustrated in FIG. 2, and generally designated 20. For present purposes, it suffices to note that the prior art sealing strip 20 includes chevron shaped upper and lower walls 22 and 24, respectively, two parallel side walls 26 and 28 joining said top and bottom walls, and, completing the construction, a vertically extending interior wall 30 connecting the chevron shapes which are located centrally of the top and bottom walls 22, 24. Referring now to FIG. 3, it will be noted that during use of the prior art sealing device 20, there is a tendency, when the joint 12 diminishes in size as a result of expansion of the concrete slabs 14 and 16, for the upper portions of the side walls 26 and 28 to pull away from the vertical faces 12*a*, 12*b* of the joint, thereby producing gaps 12*c*. Seals which pull away as noted are subject to a significant shortcoming. Very often, the seals are used as part of a gutter, which, with highway use, collects dirt and debris. Under traffic conditions, the debris continually is pounded downward and between the wall of the seal and the concrete slab. Ultimately, the expansion joint fills with uncompressible matter, and thus does not permit the dimensional changes which are required in the joint 12.

FIGS. 4 and 5 illustrate a prior art solution to the problem of maintaining continuous contact between the side walls of the seal and the concrete vertical faces. The seal being used is that which is more particularly described and illustrated in prior U.S. Pat. No. 3,521,528, which is incorporated herein in its entirety by this reference, and is substantially similar to the seal of FIG. 2. Thus, the structural features of the seal in FIG. 4 are denoted by the same reference numerals used for the seal of FIG. 2. The only difference, and the one that is significant insofar as maintaining the side walls in contact with the vertical faces of th concrete slabs, and thus obviating the gab 12*c*, are the so-called sealing tips provided thereon, herein designated 26*a* and 28*a*, which are respectively formed as a continuous, preferably pyramidal bead, located at the juncture of the top wall 22 and each of the side walls 26 and 28, and extend outwardly from the walls 26 and 28.

As illustrated in FIG. 5, however, the prior art seal 20, while solving the problem of preventing the gaps 12*c*, introduces another problem or shortcoming, which also significantly detracts from the use of the seal. As shown in FIG. 5, the middle chevron-shaped wall 23, in response to diminishment in size of the joint 12 as a result of expansion of the concrete slabs 14 and 16 towards each other, will very often assume the distorted, convoluted shape illustrated. Stated another way, there appears to be no predictability in the shape that will be assumed by the middle wall 23 in that it has been found in practice not to as readily partake of descending movement as the upper and lower walls 22 and 24 when the seal 20 undergoes compression. Thus, when the middle wall 23 becomes squeezed between the vertical faces 12*a* and 12*b* of the joint 12 and assumes the convolutions illustrated, there is a build-up of resistance against compression in the seal 20 which resists expansion in the concrete slabs 14 and 16 and is not commercially desirable.

As is well understood, sealing devices are often required to meet certain specifications and performance parameters. For example, a sealing device may typically be required to assert a lateral force of approximately three pounds in order to hold its inserted position between the concrete slabs. Thereafter, upon 25% expansion of the slabs, which produces a corresponding 25% contraction in the seal, it is typically provided that there be a build-up of force in the sealing member which does not exceed six pounds. Similarly, upon a 50% contraction in the member, it is typically provided that the force build-up does not exceed twelve pounds. It should thus be readily apparent that the unpredictable configuration or distortion which is assumed by the middle wall 23 of the prior art sealing device 20 significantly detracts from the ability of the seal to meet performance specifications.

The within inventive sealing device 10 previously noted in connection with FIG. 1 and in which the structural features are more particularly illustrated in FIGS. 6 and 7, effectively also prevents gaps 12*c* between the side wall and the vertical faces of the joint of the concrete slabs and, most important, also obviates any distortions of the seal transverse walls which cause inconsistency in the resistance of the seal to compression. As shown in FIGS. 6 and 7, the within inventive seal 10 also has spaced apart chevron-shaped walls consisting, more particularly, of a top wall 10*a*, a bottom wall 10*b* and two intermediate walls 10*c*. Like the prior art seal 20, the inventive seal 10 also has the chevron-shaped walls 10*b* and 10*c* joined at their opposite ends by two parallel side walls 10*d* and 10*e*, while the chevron shape of each wall, which is located centrally in each of these walls, and is specifically individually and collectively designated 10*f*, is connected by a vertically extending interior wall 10*g*.

More particularly, the structural feature which characterizes and sets the seal 10 apart from the prior art seals already described is the inclusion in the configuration of the seal of horizontally-extending length portions, individually and collectively designated 10*h*, which connect each of the side walls 10*d* and 10*e* with the centrally located chevron-shapes 10*f*, and in shape provide the seal with what aptly can be termed a "gull wing" contour. It has been found that because the chevron-shapes 10*f* do not start at the juncture with the side walls 10*d* and 10*e*, but rather at the juncture with the horizontally oriented or extending length portions 10*h*, that the angle of inclination of the angled or slanted length portions which form the chevron shapes 10*f* can be steeper than that provided in the prior art, and that this steepness, in practice, is effective in urging the central portion of the seal through descending movement in response to compression of the seal. In the preferred embodiment illustrated in FIG. 6, each of the angled length portions which define the chevron shapes 10*f* thus subtends an angle 10*i* of approximately 45 degrees to the horizontal, whereas in the prior art the equivalent angle wall portion subtended an angle of only 30 degrees. In the preferred embodiment illustrated in FIG. 6, it will also be understood that the chevron shapes 10*f* comprise approximatley $\frac{2}{3}$ of the lateral extent of the seal 10, while the remaining $\frac{1}{3}$ consists of the horizontally-extending length portions 10*f*.

The manner in which the central portion of the seal 10 is urged through descending movement upon compression of the seal in response to diminishment in size of the joint 12 is illustrated in FIG. 7. Also illustrated in FIG. 7 is the ability of the horizontally oriented length portions 10*h* to hold the upper corners of the side walls 10*b* and 10*e* in continuous contact with the vertical faces 12*a* and 12*b* of the joint 12, thus enabling the inventive seal 10 hereof to achieve the desirable functioning of the prior art seals 20, but without the middle walls of the seal being squeezed and made to assume distorted shapes which adversely effects the consistency with which the seal resists compression.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. In an extrusion of elastomeric material adapted to form the flexible sealing member between the vertical faces of an expansion joint of a concrete structure of the type having a periphery comprised of chevron-shaped top and bottom walls and two chevron-shaped intermediate walls and two parallel side walls joining said top and bottom and intermediate walls, and having a vertically-extending interior wall connecting said four chevron shapes located centrally of said top and bottom and intermediate walls, the improvements to said chevron-shaped top and bottom and intermediate walls consisting of means for maintaining continuous contact between said side walls and the concrete vertical faces in the form of horizontally-extending length portions of one third the total horizontal extent of said sealing member in said top and bottom and intermediate walls connecting said side walls to said centrally located chevron shapes, and said chevron shapes extending the remaining two thirds of the horizontal extent of said sealing member and being formed by angled wall length portions subtending an angle to the horizontal of at least 45 degrees, whereby the chevron shapes located inwardly of said wall horizontal length portions are urged through descending movement in response to diminishment in size of the expansion joint instead of being squeezed between said side walls.

* * * * *